US008469565B2

(12) United States Patent
Yatsuda

(10) Patent No.: US 8,469,565 B2
(45) Date of Patent: Jun. 25, 2013

(54) VEHICLE LIGHT INCLUDING MULTI-FOCAL LENS AND PLURALITY OF LIGHTING ELEMENTS

(75) Inventor: Yasushi Yatsuda, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 197 days.

(21) Appl. No.: 13/034,637

(22) Filed: Feb. 24, 2011

(65) Prior Publication Data

US 2011/0205748 A1 Aug. 25, 2011

(51) Int. Cl.
*F21V 5/08* (2006.01)

(52) U.S. Cl.
USPC . 362/522; 362/544; 362/311.01; 362/311.06; 362/332; 362/336; 359/721; 359/741

(58) Field of Classification Search
USPC ..... 362/487, 507, 520, 521, 522, 538, 362/539, 543, 544, 545, 311.01, 311.02, 362/311.06, 311.12, 326, 332, 336; 359/721, 359/741
See application file for complete search history.

(56) References Cited

U.S. PATENT DOCUMENTS

| | | | | |
|---|---|---|---|---|
| 1,208,456 | A * | 12/1916 | Bell | 362/309 |
| 2,220,639 | A * | 11/1940 | Borsarelli | 362/333 |
| 6,244,731 | B1 * | 6/2001 | Koiko et al. | 362/297 |
| 7,156,544 | B2 | 1/2007 | Ishida | |
| 7,311,430 | B2 * | 12/2007 | Tsukamoto et al. | 362/545 |
| 7,993,043 | B2 * | 8/2011 | Sazuka et al. | 362/509 |
| 2003/0174509 | A1 * | 9/2003 | Futami | 362/517 |
| 2005/0068787 | A1 * | 3/2005 | Ishida | 362/538 |
| 2009/0213608 | A1 * | 8/2009 | Mozaffari-Afshar et al. | 362/520 |

FOREIGN PATENT DOCUMENTS

JP 2005-108554 A 4/2005

* cited by examiner

*Primary Examiner* — Ismael Negron
(74) *Attorney, Agent, or Firm* — Kenealy Vaidya LLP

(57) ABSTRACT

A vehicle light includes a multi-focal lens that has a mid-level lens portion, an upper-level lens portion, and lower-level lens portion, a separator plate with a front edge positioned at or near the focal point of the mid-level lens portion, and a plurality of light emitting elements mounted on the top and bottom of the separator plate, respectively. A first elliptical reflecting surface whose first focal point is set at or near the first light emitting element and whose second focal point is set at or near the focal point of the mid-level lens portion is provided on the top of the separator plate; a second elliptical reflecting surface is provided on the bottom of the separator plate, with a first focal point set at or near the second light emitting element and the second focal point set at or near the focal point of the upper-level lens portion.

20 Claims, 12 Drawing Sheets

VEHICLE LIGHT INCLUDING MULTI-FOCAL LENS AND PLURALITY OF LIGHTING ELEMENTS

This application claims the priority benefit under 35 U.S.C. §119 of Japanese Patent Application No. 2010-038250 filed on Feb. 24, 2010, which is hereby incorporated in its entirety by reference.

TECHNICAL FIELD

The presently disclosed subject matter relates to a vehicle light, for example, a vehicle headlight, and a multi-focal lens.

BACKGROUND ART

A headlight disclosed in Japanese Patent Application Laid-Open No. 2005-108554 is configured to allow switching between a high beam mode and a low beam mode. A first semiconductor light emitting element is mounted on the upper surface of a thin plate-shaped travel blocking member in this headlight. Furthermore, a second semiconductor light emitting element is mounted on the lower surface of the travel blocking member. A projection lens is arranged in front of the travel blocking member and has a focal point that is set at or near the edge of the forward end of the travel blocking member. A first reflector is provided on the periphery of the first semiconductor light emitting element and a second reflector is provided on the periphery of the semiconductor light emitting element.

When the headlight is set to a low beam mode, only the first semiconductor light emitting element can emit light beams and when the headlight is set to the high beam mode, both of the semiconductor light emitting elements can emit light beams.

When the first semiconductor light emitting element emits light beams, the light beams emitted from the first semiconductor light emitting element are reflected by the first reflector in the forward direction to be converged close to the focal point of the projection lens. In addition to this, part of the reflected light beams is blocked by the travel blocking member. Because of this, the area being illuminated falls below the horizontal plane thereby controlling the occurrence of glare toward oncoming vehicles.

In contrast, when the second semiconductor light emitting element emits light beams, the light beams emitted from the second semiconductor light emitting element are reflected by the second reflector in the forward direction to be converged close to the focal point of the projection lens. In addition to this, part of the reflected light beams is blocked by the travel blocking member. Because of this, the area being illuminated rises above the horizontal plane and this area being illuminated by the second semiconductor light emitting element is combined with the area being illuminated by the first semiconductor light emitting element, and accordingly, the headlight can be in the high beam mode. Although reflecting surfaces are provided on the upper surface and the lower surface of the travel blocking member, even if a reflecting surface is provided, each of the light distribution patterns only will become brighter regardless of whether the area being illuminated becomes larger.

Although this is the case, because both of the semiconductor light emitting elements emit light beams when the headlight disclosed in Japanese Patent Application Laid-Open No. 2005-108554 (or its corresponding U.S. Pat. No. 7,156,544) is in the high beam mode, the power consumption of the headlight when set to the high beam mode is double the power consumption of the headlight when set to the low beam mode, thereby increasing the power consumption of the headlight when set to the high beam mode.

In addition, because the area being illuminated when the headlight is set to the high beam mode is formed by combining the area being illuminated by the first semiconductor light emitting element with the area being illuminated by the second semiconductor light emitting element, the region of brightness where the area being illuminated by the first semiconductor light emitting element and the area being illuminated by the second semiconductor light emitting element are overlapped becomes much brighter than other regions of brightness. For this reason, the association of the illumination distribution when the headlight is set to the high beam mode can deteriorate and cause uneven brightness.

SUMMARY

The presently disclosed subject matter was devised in view of these and other problems and features and in association with the conventional art. According to an aspect of the presently disclosed subject matter, a headlight that switches between a high beam mode and a low beam mode can form a light distribution pattern that prevents uneven brightness when the headlight is set to the high beam mode as well minimizes the power consumption when the headlight is set to the high beam mode.

According to another aspect of the presently disclosed subject matter, a vehicle light can include: a multi-focal lens that has a mid-level lens portion whose focal point is set on an optical axis extending in a front-to-rear direction and an upper-level lens portion that is provided on the mid-level lens portion and whose focal point is set diagonally forward higher than the focal point of the mid-level lens portion; a separator plate that is provided in a face-down state with respect to a horizontal plane at the rear of the multi-focal lens and has a front edge positioned at or near the focal point of the mid-level lens portion; a first light emitting element that is mounted on top of the separator plate at the rear further from the front edge of the separator plate and is arranged facing upwards; a second light emitting element that is mounted on a bottom of the separator plate at the rear further from the front edge of the separator plate and is arranged facing downwards; a first elliptical reflecting surface that is provided on the top of the separator plate, whose first focal point is set at or near the first light emitting element and whose second focal point is set at or near the focal point of the mid-level lens portion; and a second elliptical reflecting surface that is provided on the bottom of the separator plate, whose first focal point is set at or near the second light emitting element and whose second focal point is set at or near the focal point of the upper-level lens portion. This vehicle light can be configured such that the first light emitting element and the second light emitting element selectively emit light beams.

The multi-focal lens can further have a lower-level lens portion that is provided on the bottom of the mid-level lens portion and whose focal point is set diagonally rearward lower than the focal point of the mid-level lens portion. The vehicle light can further include a hyperbolic reflecting surface that is arranged diagonally forward under the second elliptical reflecting surface and whose inner focal point is set at or near the second light emitting element and whose outer focal point is set at or near the focal point of the lower-level lens portion.

When viewing the multi-focal lens from the front, the surface area of the region occupied by the mid-level lens portion may approximately be the sum of the surface area of the region occupied by the upper-level lens portion and the surface area of the region occupied by the lower-level lens portion.

The vehicle light can further include a flat reflecting surface that is formed between the front edge of the upper surface of the separator plate and the first light emitting element and is arranged parallel to the horizontal plane.

The multi-focal lens can further include a lens used for distributing light of an overhead sign provided on the upper left or the upper right of the upper-level lens portion and whose focal point is set further above and in front of the focal point of the upper-level lens portion. In addition, the vehicle light can further include a third elliptical reflecting surface that is arranged diagonally forward above the first elliptical reflecting surface, whose first focal point is set at or near the first light emitting element and whose second focal point is set at or near the focal point of the lens used for distributing light of an overhead sign.

The first light emitting element can be oriented upward in a state inclining rearward 0° to 20° with respect to the vertical direction.

The second light emitting element can be oriented downward in a state inclining forward 10° to 20° with respect to the vertical direction.

A multi-focal lens made in accordance with principles of the presently disclosed subject matter can include a mid-level lens portion whose focal point is set on an optical axis extending in a front-to-rear direction and an upper-level lens portion that is provided on the mid-level lens portion and whose focal point is set diagonally forward higher than the focal point of the mid-level lens portion.

The multi-focal lens, can further include a lower-level lens portion that is provided on the bottom of the mid-level lens portion and whose focal point is set diagonally rearward lower than the focal point of the mid-level lens portion.

The multi-focal lens can further include a lens used for distributing light of an overhead sign, the lens being provided on the upper left or the upper right of the upper-level lens portion and whose focal point is set further above and in front of the focal point of the upper-level lens portion.

When the vehicle light is set to a low beam mode, the first semiconductor light emitting element can emit light beams and when the vehicle light is set to a high beam mode, the second semiconductor light emitting element can emit light beams while the first semiconductor light emitting element does not emit light beams. Because the light beams are selectively emitted and two light emitting elements will not emit light beams at the same time, the power consumption can be controlled. In particular, because the focal point of the upper-level lens portion can be set further in front of the front edge of the separator plate and the second focal point of the second elliptical reflecting surface can be set at or near the focal point of the upper-level lens portion, the light beams emitted from the second light emitting element when the vehicle light is set to the high beam mode are hardly blocked thereby making it possible to suppress the power consumption.

Furthermore, because the light distribution when the vehicle light is set to the high beam mode is obtained by the second light emitting element without the illumination ranges obtained by the two light emitting elements overlapping, unevenness of the brightness distribution of the light distribution pattern can be suppressed.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lights and multi-focal lenses of the presently disclosed subject matter with reference to the accompanying drawings and in accordance with exemplary embodiments. Although various types of technical features are described with respect to the following exemplary embodiments described below in order to embody the presently disclosed subject matter, the scope of the presently disclosed subject matter is not limited to the following embodiments and illustrated examples.

In addition, in the following description "above," "below," "front," "rear," "left," and "right" refer to the "above," "below," "front," "rear," "left," and "right," respectively, of a vehicle equipped with a headlight. Furthermore, the direction along the longitudinal length of a vehicle body shall refer to "front-to-rear direction (equivalently rear-to-front direction)" or "longitudinal direction," while the direction in the vehicle width direction shall refer to "horizontal direction," "right-to-left direction (equivalently left-to-right direction)," "widthwise direction," or "crosswise direction." In addition to this, a left/right orientation is established as seen from the rear towards the front.

Figure 1:
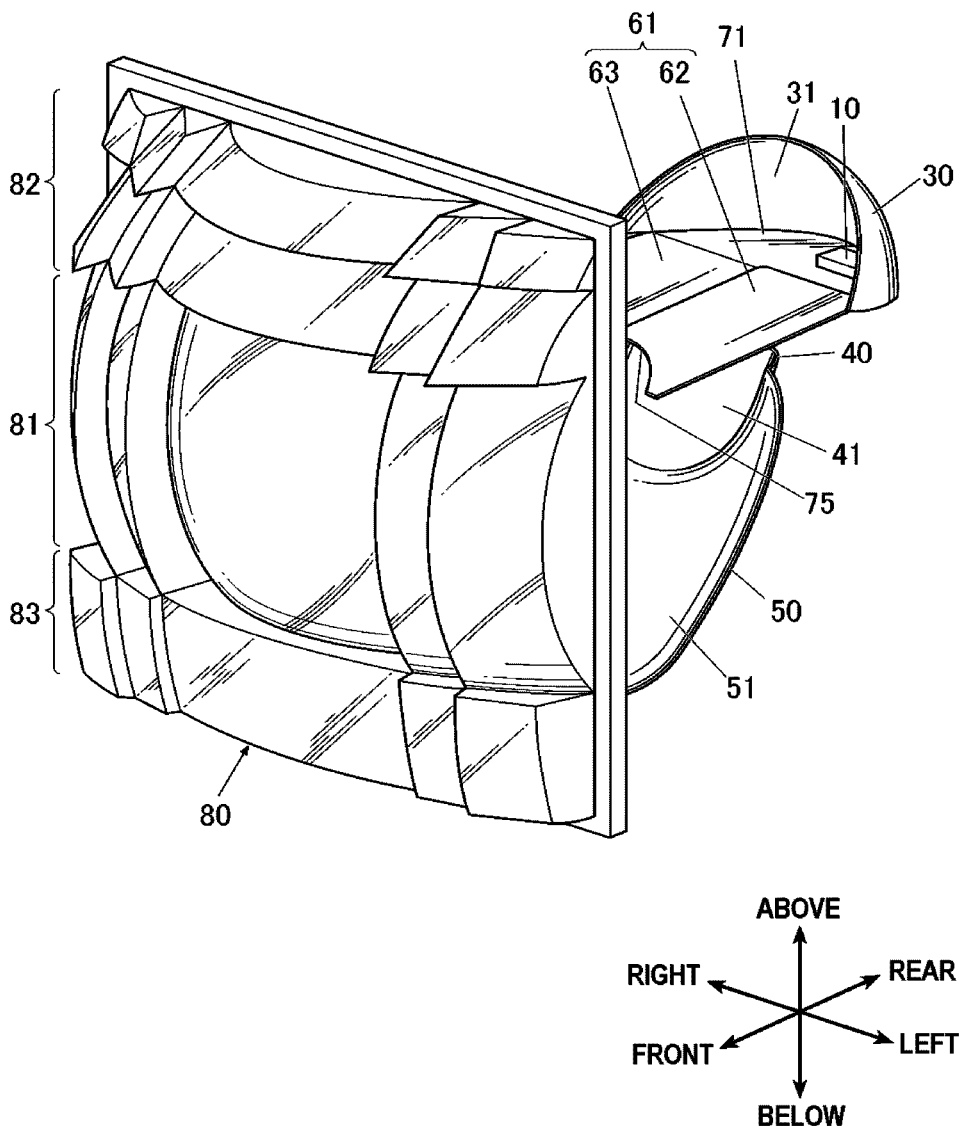
FIG. 1 is a front perspective view of a headlight of a first exemplary embodiment made in accordance with principles of the presently disclosed subject matter.
Figure 2:
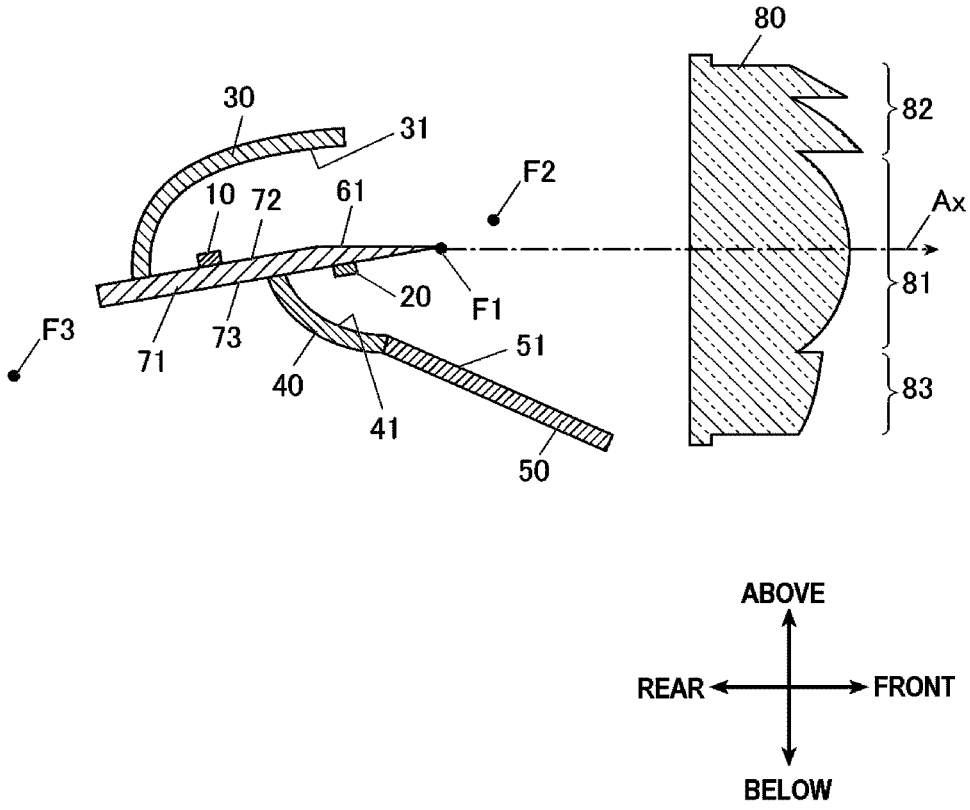
FIG. 2 is a vertical cross sectional view of the headlight of the first exemplary embodiment.
Figure 3:
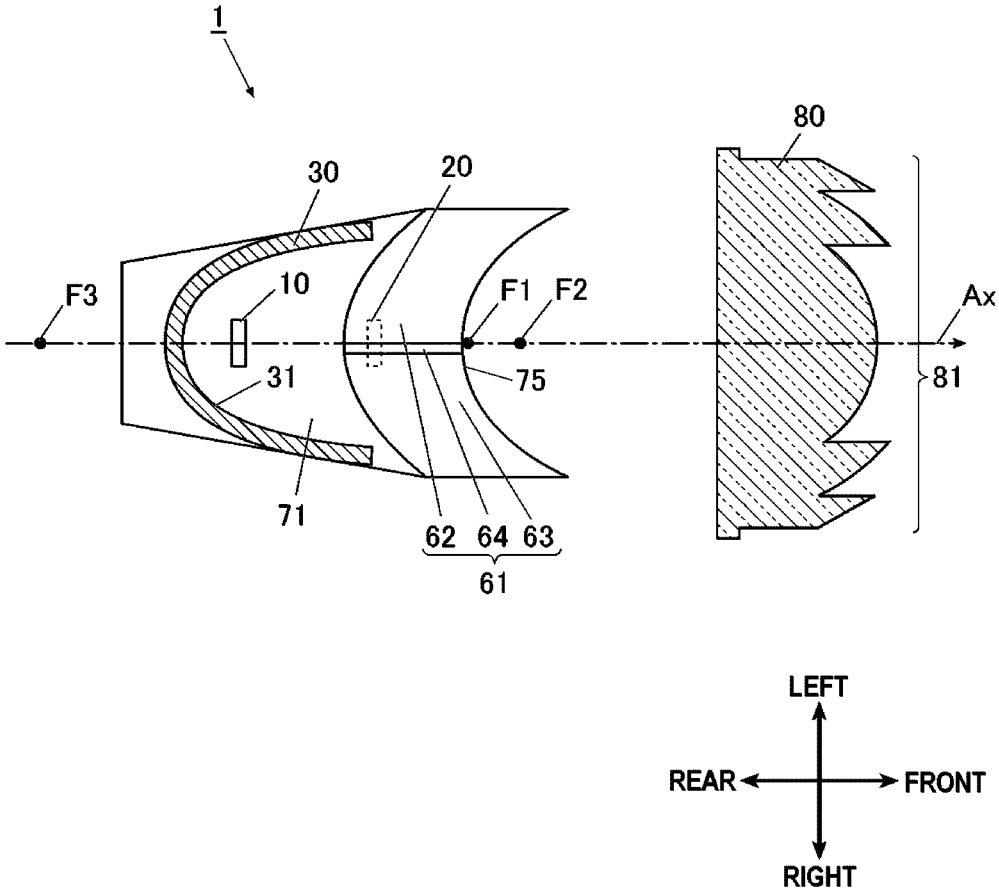
FIG. 3 is a horizontal cross sectional view of the headlight of the first exemplary embodiment.
Figure 4D:
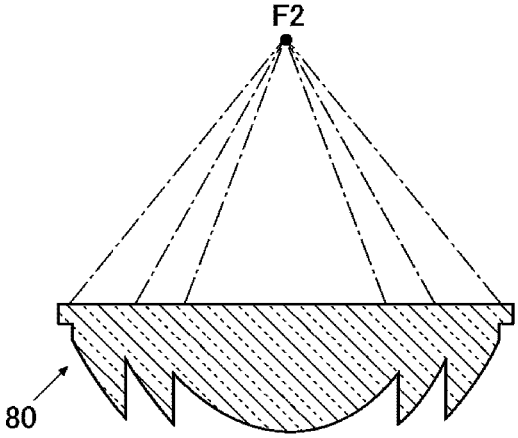
FIGS. 4A, 4B, 4C, and 4D are a front view of the multi-focal lens of the first exemplary embodiment, a side view of the multi-focal lens, a bottom view of the multi-focal lens and a cross sectional view taken along line D-D of the multi-focal lens of FIG. 4A, respectively.
Figure 4B:
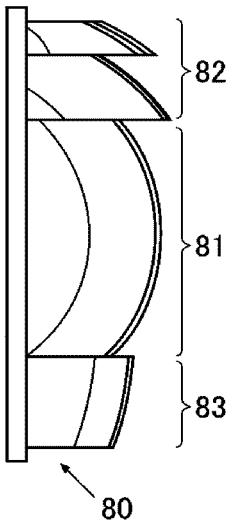
Figure 4A:
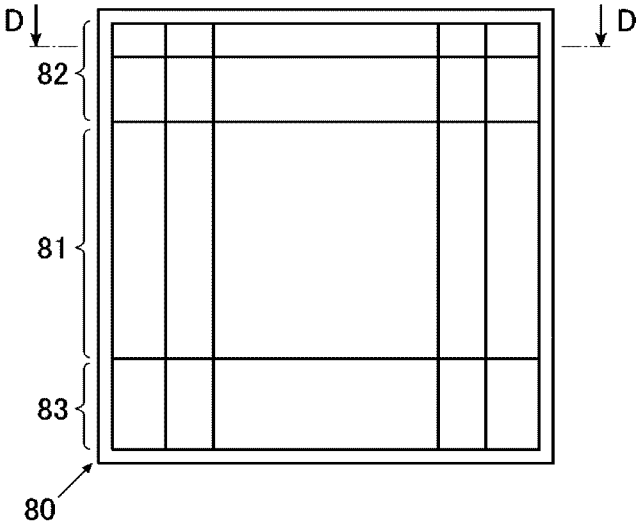
Figure 4C:
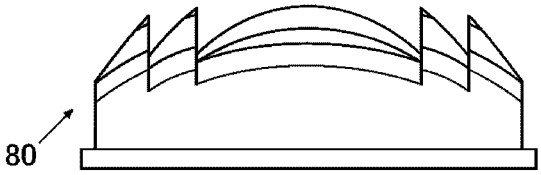

FIG. 1 is a front perspective view of a headlight 1 as one exemplary embodiment of a vehicle light made in accordance with principles of the presently disclosed subject matter. FIG. 2 is a cross sectional view taken along the vertical cross-section passing through an optical axis Ax. FIG. 3 is a cross sectional view taken along the horizontal cross-section passing through the optical axis Ax.

The exemplary headlight 1 can be configured to include a first light emitting element 10, a second light emitting element 20, a first elliptical reflector 30, a second elliptical reflector 40, a hyperbolic reflector 50, a separator plate 71, a multi-focal lens 80 and other components.

The multi-focal lens 80 can be a convex lens. FIGS. 4A, 4B, 4C, and 4D are a front view, a side view, a bottom view, and a cross sectional view taken along line D-D of the multi-focal lens 80, respectively. As shown in FIG. 1 to FIGS. 4A to 4D, the multi-focal lens 80 can be configured to include a mid-level lens portion 81, an upper-level lens portion 82, and a lower-level lens portion 83. These lenses 81 to 83 can be integrally formed, but could also be separately formed and subsequently attached. The optical axis Ax of the multi-focal lens 80 can extend in the front-to-rear direction passing through the center of the mid-level lens portion 81 (vertex of the front exit surface of the mid-level lens portion 81). In the present exemplary embodiment, when viewing the multi-focal lens 80 in a direction parallel to the optical axis Ax from the front, the surface area of the region occupied by the mid-level lens portion 81 can be almost or substantially equal to the sum of the surface area of the region occupied by the upper-level lens portion 82 and the surface area of the region occupied by the lower-level lens portion 83. The rear surface of the multi-focal lens 80 can form a backside plane of incidence of the lens portions 81 to 83 and can be configured as a plane perpendicular to the optical axis Ax of the multi-focal lens 80.

The mid-level lens portion 81 can be configured to include an aspherical convex lens and the focal point F1 of the mid-level lens portion 81 may be set on the optical axis Ax at the rear of the mid-level lens portion 81. The upper-level lens portion 82 can be configured to include an aspherical convex lens and the focal point F2 of the upper-level lens portion 82 may be set at the rear of the upper-level lens portion 82. The lower-level lens portion 83 can be configured to include an aspherical convex lens and the focal point F3 of the lower-level lens portion 83 may be set at the rear of the lower-level lens portion 83.

The focal lengths of these lens portions 81 to 83 can be different. More specifically, as shown in FIG. 2 and FIG. 3, from among these lens portions 81 to 83, the focal length of the lower-level lens portion 83 may be the longest and the focal length of the upper-level lens portion 82 may be the shortest. Therefore, the focal point F2 of the upper-level lens portion 82 is positioned in front of the focal point F1 of the mid-level lens portion 81 and the focal point F1 of the mid-level lens portion 81 is positioned in front of the focal point F3 of the lower-level lens portion 83. In other words, the rear-front axis coordinate position for the focal point F1 is located between the rear-front axis coordinate position for the focal point F2 and the rear-front axis coordinate position for the focal point F3, as can best be seen in FIG. 2.

As shown in FIG. 3, when viewed in the vertical direction, the optical axis Ax may pass through the focal points F1 to F3 of these lens portions 81 to 83 and these focal points F1 to F3 may be arranged backward and forward along the optical axis Ax. In contrast, as shown in FIG. 2, when viewed in the horizontal direction (equivalently crosswise or right-to-left direction), the optical axis Ax may pass through the focal point F1 of the mid-level lens portion 81, the focal point F2 of the upper-level lens portion 82 may be arranged so as to be shifted above the optical axis Ax, and the focal point F3 of the lower-level lens portion 83 may be arranged so as to be shifted below the optical axis Ax. Because of this, the focal point F1 of the mid-level lens portion 81 may be positioned above the focal point F3 of the lower-level lens portion 83 and the focal point F2 of the upper-level lens portion 82 may be positioned above the focal point F1 of the mid-level lens portion 81.

The front exit surfaces of the lens portions 81 to 83 can be each divided into a Fresnel cut shape. In addition, each of the front exit surfaces can also be a single aspherical surface without dividing the front exit surfaces of the lens portions 81 to 83 into a Fresnel cut shape.

As shown in FIG. 1 to FIG. 3, the light emitting elements 10 and 20, reflectors 30, 40, and 50, and a separator plate 71 can be arranged at the rear of the multi-focal lens 80.

The separator plate 71 may be provided in a face-down state with respect to the horizontal plane. The separator plate 71 can incline upwards towards the front, the rear portion of the upper surface 72 of the separator plate 71 (portion outside the flat reflecting surface 61 described later) can incline upwards towards the front and extend towards the optical axis Ax, and the lower surface 73 of the separator plate 71 can also incline upwards towards the front and extend towards the optical axis Ax. If the rear portion of the upper surface 72 of the separator plate 71 were to extend in coplanar fashion towards the front side, the focal point F2 of the upper-level lens portion 82 can be positioned below that extended surface. A heat sink (not shown in the figure) can be provided at the rear of the separator plate 71. The rear end of the separator plate 71 could be connected to the heat sink.

The front edge 75 of the separator plate 71 can be positioned at or near the focal point F1 of the mid-level lens portion 81. The front edge 75 of the separator plate 71 can also be positioned at the second focal point F32 of the first elliptical reflecting surface 31. Moreover, the front edge 75 of the separator plate 71 can be curved so as to be indented towards the rear corresponding to the field curvature of the mid-level lens portion 81.

The flat reflecting surface 61 can be formed on the front portion of the upper surface 72 of the separator plate 71 and the front edge 75 of the separator plate 71 can be the front edge of the flat reflecting surface 61. This flat reflecting surface 61 can be a surface parallel to the optical axis Ax (and can actually be substantially coplanar with a horizontal plane that contains the optical axis Ax). The reflecting surface 61 can also be arranged in front of the first light emitting element 10. From among the flat reflecting surface 61, the portion 62 further left than the optical axis Ax (hereinafter, referred to as a left portion plane surface 62 as shown in FIG. 3) may be a horizontal surface and the portion 63 further right than the optical axis Ax (hereinafter, referred to as a right portion plane surface 63) may be a horizontal surface. There can be level differences between the left portion plane surface 62 and the right portion plane surface 63. The portion 64 between the left portion plane surface 62 and the right portion plane surface 63 (hereinafter, referred to as an inclined plane 64) can be inclined with respect to the horizontal direction. The inclination angle of the inclined plane 64 can be 15° or 45° with respect to the horizontal plane in relation with forming an oblique cutoff line of a low beam.

From among the portions that make up the flat reflecting surface 61, the portion on the side of the vehicle traffic lane can be set away from the optical axis Ax at a located that is higher than the portion on the opposite side of the vehicle traffic lane. More specifically, when the headlight 1 is used for left-hand traffic, the left portion plane surface 62 can be positioned above the right portion plane surface 63 and the inclined plane 64 may incline downward towards the right. In contrast, when the headlight 1 is used for right-hand traffic, the right portion plane surface 63 can be positioned above the left portion plane surface 62 and the inclined plane 64 can incline downward towards the left.

The upper and lower positions of the left portion plane surface 62 and the right portion plane surface 63 can be aligned and the inclined plane 64 may be eliminated.

The first light emitting element 10 can be mounted onto the upper surface 72 of the separator plate 71 further back from the front edge 75 of the separator plate 71. The second light emitting element 20 can be mounted onto the lower surface 73 of the separator plate 71 further back from the front edge 75 of the separator plate 71. The first light emitting element 10 can face upward and the second light emitting element 20 can face downward. More specifically, in the present exemplary embodiment, the rear portion of the upper surface 72 of the separator plate 71 may incline downward towards the rear from 0° to 20° using a horizontal plane as a reference and the first light emitting element 10 may face upward in a state in which the optical axis of the light emitting element 10 leans rearward from 0° to 20° with respect to the vertical (above-below) direction. Even further, in the present exemplary embodiment, the lower surface 73 of the separator plate 71 may incline downward towards the rear from 10° to 30° using a horizontal plane as a reference and the second light emitting element 20 may face downward in a state in which the optical axis of the light emitting element leans forward from 10° to 20° with respect to the vertical direction.

If the first light emitting element 10 is seen in a plan view from the rear obliquely upward, the long side of this first light emitting element 10 will be horizontal in addition to the first light emitting element 10 being arranged so as to be parallel to the right-to-left direction. If the second light emitting element 20 is seen in a plan view from the rear obliquely downward, the long side of this first second emitting element 20 will be horizontal in addition to the second light emitting element 20 being arranged so as to be parallel to the right-to-left direction.

With regard to the positional relationship in the front-to-rear direction (direction along the optical axis Ax) of these light emitting elements 10 and 20, these light emitting elements 10 and 20 can be arranged between the focal point F1 and the focal point F3 while the second light emitting element 20 can be arranged further rearward than the first light emitting element 20. As far as the positions in the right-to-left direction of these light emitting elements 10 and 20 are concerned, these light emitting elements 10 and 20 may overlap on the optical axis Ax when seen from above. These light emitting elements 10 and 20 may be light emitting diodes, inorganic electroluminescent devices, organic electroluminescent devices, or other semiconductor light emitting elements.

The first elliptical reflector 30 can be provided on the separator plate 71 and can be arranged higher (in the above-below coordinate system) than the focal point F3 of the lower-level lens portion 83. This first elliptical reflector 30 may be formed in an approximate half-dome shape so as to enclose the first light emitting element 10 in a state in which it is inclining forward above the first light emitting element 10 from the rear of the first light emitting element 10, inclining forward towards the right, and inclining forward towards the left. The front inner side of the first elliptical reflector 30 can be formed as the concave first elliptical reflecting surface 31.

Figure 5:
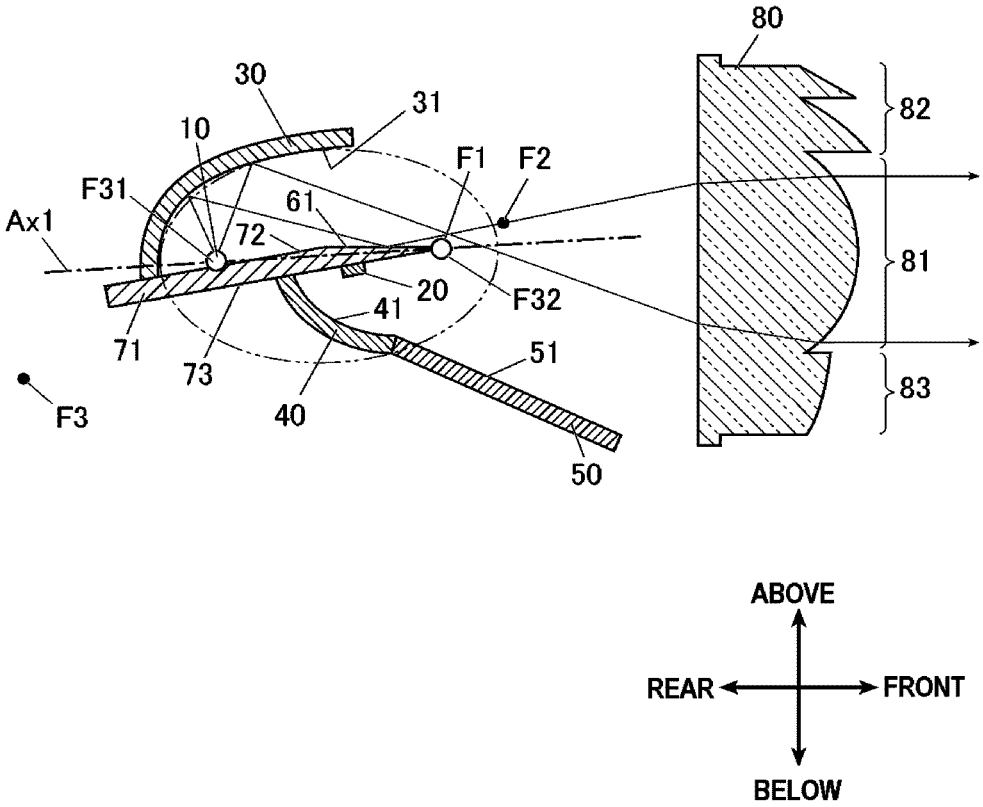
FIG. 5 is a vertical cross sectional view of the headlight of the first exemplary embodiment.

As shown in FIG. 5, the first elliptical reflecting surface 31 can be formed in an elliptical shape. The elliptical surface may be a revolved elliptical surface around the axis Ax1 that extends in the front-to-rear direction as a rotational axis or a free curved surface based on the revolved elliptical surface. In addition, the first elliptical reflecting surface 31 can be a compound elliptical surface that can be obtained by combining this revolved elliptical surface and this free curved surface. Although the axis Ax1 of the first elliptical reflecting surface 31 inclines upwards towards the front, the axis Ax1 can also be parallel to the optical axis Ax. The axis Ax1 can also overlap the optical axis Ax.

The first focal point F31 of the first elliptical reflecting surface 31 can be set at the inside of the first elliptical reflector 30 and the second focal point F32 of the first elliptical reflecting surface 31 can be set further in front of the first focal point F31. The second focal point F32 of the first elliptical reflecting surface 31 may extend in the horizontal direction so as to be a focal line curved so as to be convex towards the rear. The first focal point F31 of the first elliptical reflecting surface 31 can be positioned at or near the first light emitting element 10. The second focal point F32 of the first elliptical reflecting surface 31 can be positioned at or near the focal point F1 of the mid-level lens portion 81. Furthermore, the second focal point F32 of the first elliptical reflecting surface 31 can be positioned at or near the front edge 75 of the separator plate 71.

The first elliptical reflecting surface 31 can reflect the light beams emitted from the first light emitting element 10 towards the front. This reflected light beams can be converged at or near the focal point F1 of the mid-level lens portion 81. It should be noted that the separator plate 71 can function as a shade that blocks part of the reflected light beams emitted from the first light emitting element 10 and reflected towards the front by the first elliptical reflecting surface 31.

The second elliptical reflector 40 can be provided below the separator plate 71. This second elliptical reflector 40 can be provided in an approximate half-dome shape so as to enclose the second light emitting element 20 in a state in which it is inclining forward above the second light emitting element 20 from the rear of the second light emitting element 20, inclining forward towards the right, and inclining forward towards the left. The front inner side of the second elliptical reflector 40 can be formed as a concave second elliptical reflecting surface 41.

Figure 6:
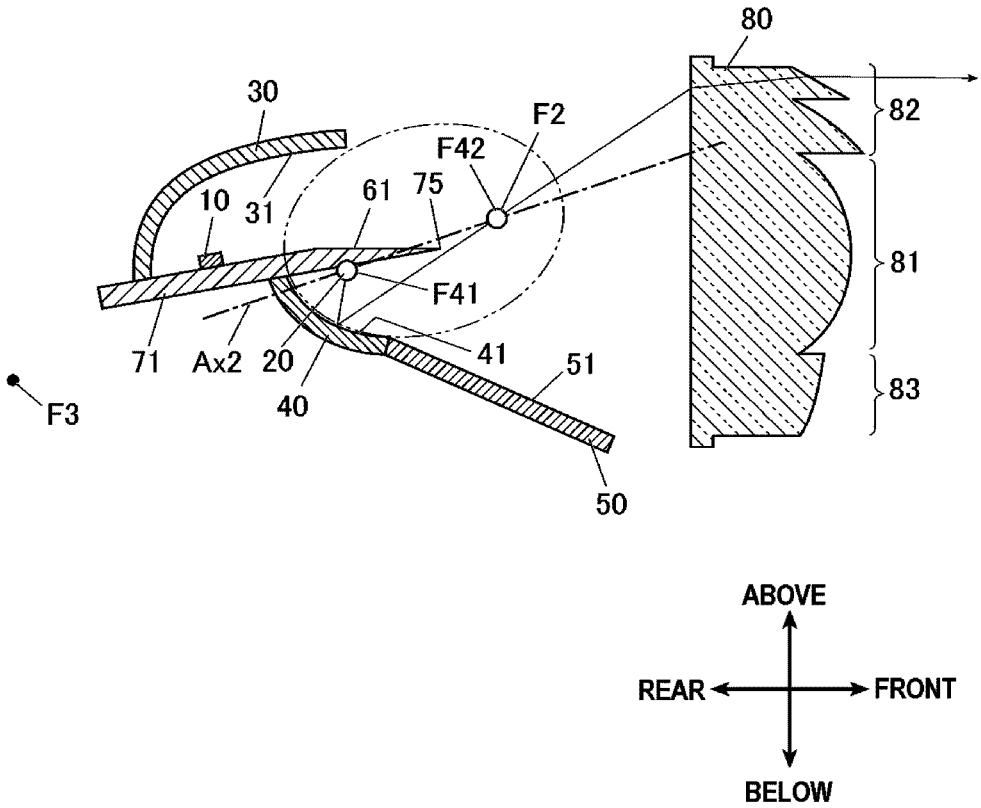
FIG. 6 is a vertical cross sectional view of the headlight of the first exemplary embodiment.

As shown in FIG. 6, the second elliptical reflecting surface 41 can be formed in an elliptical shape. In other words, the second elliptical reflecting surface 41 can be a revolved elliptical surface around the axis Ax2 that extends in the front-to-rear direction as a rotation axis or a free curved surface based on the revolved elliptical surface. In addition, the second elliptical reflecting surface 41 can be a compound elliptical surface that is obtained by combining this revolved elliptical surface with the free curved surface. The axis Ax2 of the second elliptical reflecting surface 41 can incline upwards towards the front.

The first focal point F41 of the second elliptical reflecting surface 41 can be set inside the second elliptical reflector 40 and the second focal point F42 of the second elliptical reflecting surface 41 can be set further in front of the first focal point F41 of the second elliptical reflecting surface 41. The first focal point F41 of the second elliptical reflecting surface 41 can be positioned at or near (i.e., substantially at) the second light emitting element 20. The second focal point F42 of the second elliptical reflecting surface 41 can be set at or near the focal point F2 of the upper-level lens portion 82. The first focal point F41 of the second elliptical reflecting surface 41 can be positioned further in front of the first focal point F31 of the first elliptical reflecting surface 31, and the second focal point F42 of the second elliptical reflecting surface 41 can be positioned diagonally above and further in front of the second focal point F32 of the first elliptical reflecting surface 31. The distance from the first focal point F41 of the second elliptical reflecting surface 41 to the second focal point F42 is shorter than the distance from the first focal point F31 of the first elliptical reflecting surface 31 to the second focal point F32. The vertex of the second elliptical reflecting surface 41 (the intersection of the second elliptical reflecting surface 41 and the axis Ax2) can be positioned further in front of the vertex of the first elliptical reflecting surface 31 (the intersection of the first elliptical reflecting surface 31 and the axis Ax1). In addition, the second focal point F42 of the second elliptical reflecting surface 41 can be positioned further in front of the front edge 75 of the separator plate 71.

The second elliptical reflecting surface 41 can reflect light beams emitted from the second light emitting element 20 towards the front so that the reflected light beams can be converged at or near the focal point F2 of the upper-level lens portion 82. The second focal point F42 of the second elliptical reflecting surface 41 can be separated forward from the front edge 75 of the separator plate 71. Because of this, the light beams reflected forward by means of the second elliptical reflecting surface 41 is almost, but not entirely blocked by the separator plate 71.

A hyperbolic reflector 50 can be located diagonally downwards towards the front from the second light emitting element 20. In the present exemplary embodiment, this hyperbolic reflector 50 and the second elliptical reflector 40 may be integrally formed. More specifically, the hyperbolic reflector 50 can suspend diagonally downwards towards the front from the second elliptical reflector 40 and the top of the hyperbolic reflector 50 and the front end of the second elliptical reflector 40 can be joined.

Figure 7:
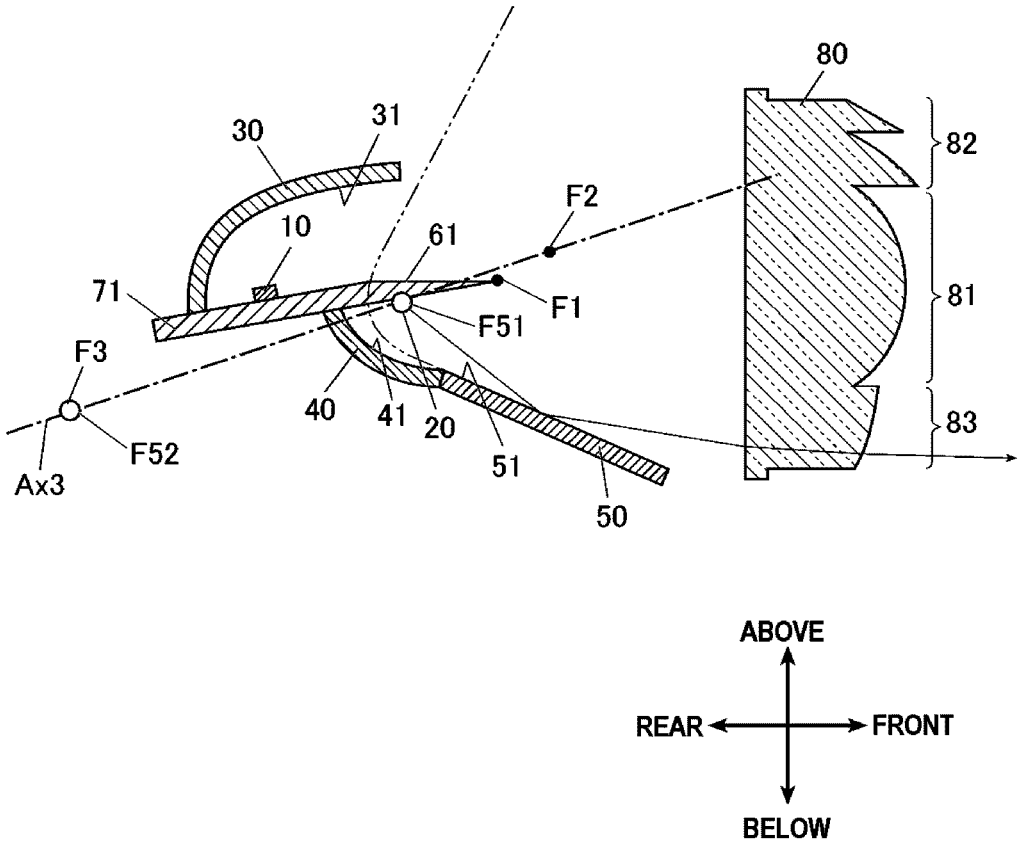
FIG. 7 is a vertical cross sectional view of the headlight of the first exemplary embodiment.

As shown in FIG. 7, the inner surface of the hyperbolic reflector 50 can be formed as a concave hyperbolic reflecting surface 51. The hyperbolic reflecting surface 51 can be a revolved hyperboloid of two surfaces around the axis Ax3 that extends in the front-to-rear direction as a rotation axis or a free curved surface based on that revolved hyperboloid surface. Although the axis Ax3 of the hyperbolic reflecting surface 51 inclines upward towards the front, the axis Ax3 can also be parallel to the optical axis Ax.

The inside focal point F51 (first focal point) of the hyperbolic reflecting surface 51 can be set further in front of the outside focal point F52 (second focal point) of the hyperbolic reflecting surface 51. The inside focal point F51 of the hyperbolic reflecting surface 51 can be positioned at or near the second light emitting element 20. The outside focal point F52 of the hyperbolic reflecting surface 51 can be positioned at or near the focal point F3 of the lower-level lens portion 83.

An exemplary operation of the headlight 1 will now be described.

The light emitting elements 10 and 20 can selectively emit light beams. In other words, when the first light emitting element 10 emits light beams, the second light emitting element 20 can be configured to not emit light beams and when the second light emitting element 20 emits light beams, the first light emitting element 10 can be configured to not emit light beams. The selective emission of light beams from the light emitting elements 10 and 20 can be performed by means of a switching circuit.

The distribution of light beams when the first light emitting element 10 is emitting light beams will be described with reference to FIG. 5.

When the first light emitting element 10 emits light beams, the light beams emitted from this light emitting element 10 can be reflected forward by the first elliptical reflecting surface 31 so that the reflected light beams can be converged on the second focal point F32 of the first elliptical reflecting surface 31. In addition, that reflected light beams can be projected forward by the mid-level lens portion 81. Because the second focal point F32 of the first elliptical reflecting surface 31 can be positioned at or near the focal point F1 of the mid-level lens portion 81, the light beams reflected by the first elliptical reflecting surface 31 towards the front by the mid-level lens portion 81 are almost parallel beams.

Figure 8A:
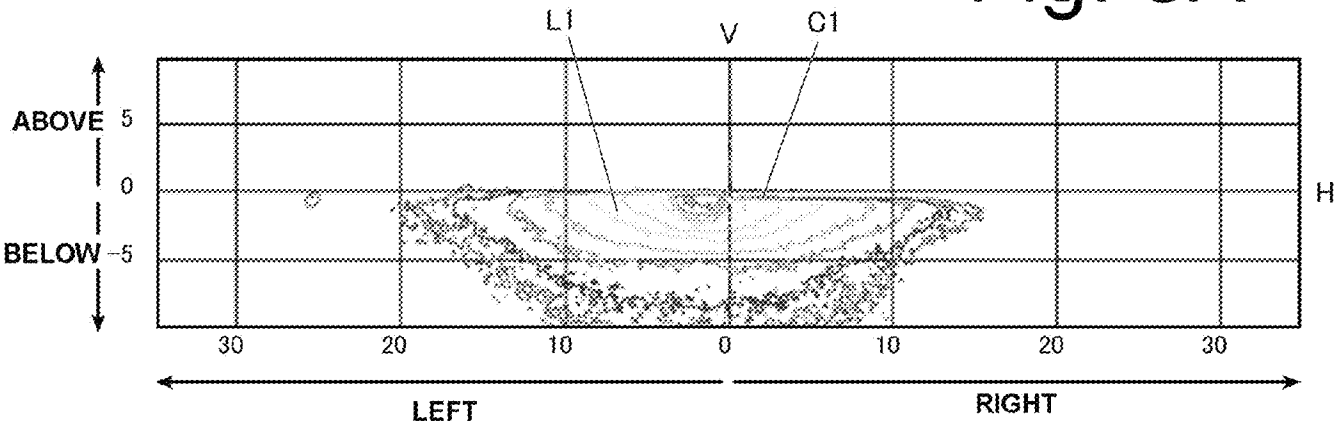
FIGS. 8A and 8B show light distribution patterns formed on a virtual screen by the headlight of the first exemplary embodiment.

The front edge 75 of the separation plate 71 (front edge 75 of the flat reflecting surface 61) can be positioned at or near the focal point F1 of the mid-level lens portion 81, and can also be positioned at or near the second focal point F32 of the first elliptical reflecting surface 31. Because of this, the light beams reflected by the first elliptical reflecting surface 31 can pass from the rear along a path that is higher and above the focal point F1 of the mid-level lens portion 81 and can be incident on the mid-level lens portion 81. However, the reflected light beams do not necessarily pass through from the rear to the front at a location lower than the focal point F1 of the mid-level lens portion 81 (refer to FIG. 5). For this reason, the light beams that are reflected by the first elliptical reflecting surface 31 and which are then projected towards the front by the mid-level lens portion 81 can form a light distribution pattern used for a low beam towards the front of the headlight 1 as shown in FIG. 8A (for low beam). FIG. 8A is an equiluminous line showing a light distribution pattern, formed on a virtual screen separated at a fixed distance towards the front from the headlight 1 when the first light emitting element 10 emits light beams. In FIG. 8A, the horizontal axis shows a horizontal angle while the intersection between the optical axis Ax and the virtual screen is represented by zero degrees and the vertical axis shows a vertical angle while the intersection between the optical axis Ax and the virtual screen is represented by zero degrees.

As shown in FIG. 8A, this light distribution pattern can have a cutoff line (bright/dark boundary line) C1 on the upper edge of a bright portion L1 along the intersection H (line of zero degrees in the vertical direction centered on the optical axis Ax) between the horizontal plane that passes through the optical axis Ax and the virtual screen. Level differences occur at the left and right of the cutoff line C1 in response to the level differences of the front edge 75 of the flat reflecting surface 61 along with an inclined cutoff line being formed close to the left and right of zero degrees.

Since the upper-level lens portion 82 can be positioned higher than the axis Ax of the first elliptical reflecting surface 31, the light beams reflected by the first elliptical reflecting surface 31 are not incident on the upper-level lens portion 82. Because of this, the upper-level lens portion 82 does not cause glare to oncoming vehicle and also has no affect on the shape of the light distribution pattern as shown in FIG. 8A.

In addition, even if part of the light reflected by the first elliptical reflecting surface 31 is slightly incident on the lower-level lens portion 83, since the first elliptical reflecting surface 31 is positioned higher than the focal point F3 of the lower-level lens portion 83, the extended light beams towards the rear of the light beam reflected by the first elliptical reflecting surface 31 will pass over the focal point F3 of the lower-level lens portion 83. Therefore, the illumination range of the light beams reflected by the first elliptical reflecting surface 31 and then projected by the lower-level lens portion 83 will be within bright portion L1 of the light distribution pattern shown in FIG. 8A. Consequently, the lower-level lens portion 83 will only brighten the bright portion L1 of the light distribution pattern shown in FIG. 8A and not affect the shape of the light distribution pattern as well as not cause any glare to oncoming vehicles.

Moreover, part of the light beams reflected by the first elliptical reflecting surface 31 can be reflected by the flat reflecting surface 61. The light beams reflected by the flat reflecting surface can be projected forward by the mid-level lens portion 81. The light beams reflected by the flat reflecting surface 61 can pass from the rear to the front higher than the focal point F1 of the mid-level lens portion 81. Because of this, the illumination range of the light beams reflected by the flat reflecting surface 61 and projected by the mid-level lens portion 81 will be within bright portion L1 of the light distribution pattern shown in FIG. 8A. Consequently, the flat reflecting surface 61 will only brighten the bright portion L1 of the light distribution pattern shown in FIG. 8A and not affect the shape of the light distribution pattern as well as not cause glare to oncoming vehicles.

Moreover, part of the light beams reflected by the flat reflecting surface 61 can be incident on the upper-level lens portion 82 and be projected forward. The light beams reflected by the flat reflecting surface 61 can pass from the rear to the front higher than the focal point F2 of the upper-level lens portion 82. Because of this, the illumination range of the light beams reflected by the flat reflecting surface 61 and projected by the upper-level lens portion 82 will be within bright portion L1 of the light distribution pattern shown in FIG. 8A. Consequently, the flat reflecting surface 61 and the upper-level lens portion 82 will only brighten the bright portion L1 of the light distribution pattern shown in FIG. 8A and not affect the shape of the light distribution pattern as shown in FIG. 8A and will not cause glare to oncoming vehicles.

Since the lower-level lens portion 83 can be positioned lower than the flat reflecting surface 61, the light beams reflected by the flat reflecting surface 61 may not be incident on the lower-level lens portion 83. Because of this, the flat reflecting surface 61 and the lower-level lens portion 83 do not necessarily affect the shape of the light distribution pattern, and may not cause glare to oncoming vehicles.

The light beams emitted from the first light emitting element 10 can be incident on the upper-level lens portion 82 without being reflected by the reflecting surfaces 31 and 61. The surface whereon the rear portion of the upper surface 72 on which the first light emitting element 10 is mounted is extending towards the front can pass above the focal point F2 of the upper-level lens portion 82. Therefore, the light beams directly incident on the upper-level lens portion 82 from the light emitting element 10 can pass above the focal point F2 of the upper-level lens portion 82. The light beams can only illuminate the bright portion L1 of the light distribution pattern shown in FIG. 8A. Therefore, the light beams directly incident on the upper-level lens portion 82 from the light emitting element 10 can only brighten the bright portion L1 of the light distribution pattern shown in FIG. 8A, and may not affect the shape of the light distribution pattern and may not cause glare to oncoming vehicles.

The distribution of light when the second light emitting element 20 is emitting light beams will be described with reference to FIG. 6.

When the second light emitting element 20 emits light beams, the light beams emitted from this light emitting element 20 can be reflected forward by the second elliptical reflecting surface 41 so that the reflected light beams can be converged on the second focal point F42 of the second elliptical reflecting surface 41. In addition, the reflected light beams can be projected forward by the upper-level lens portion 82. Because the second focal point F42 of the second elliptical reflecting surface 41 can be positioned at or near the focal point F2 of the upper-level lens portion 82, the light beams reflected by the second elliptical reflecting surface 41 towards the front by the upper-level lens portion 82 are substantially parallel beams.

Figure 8B:
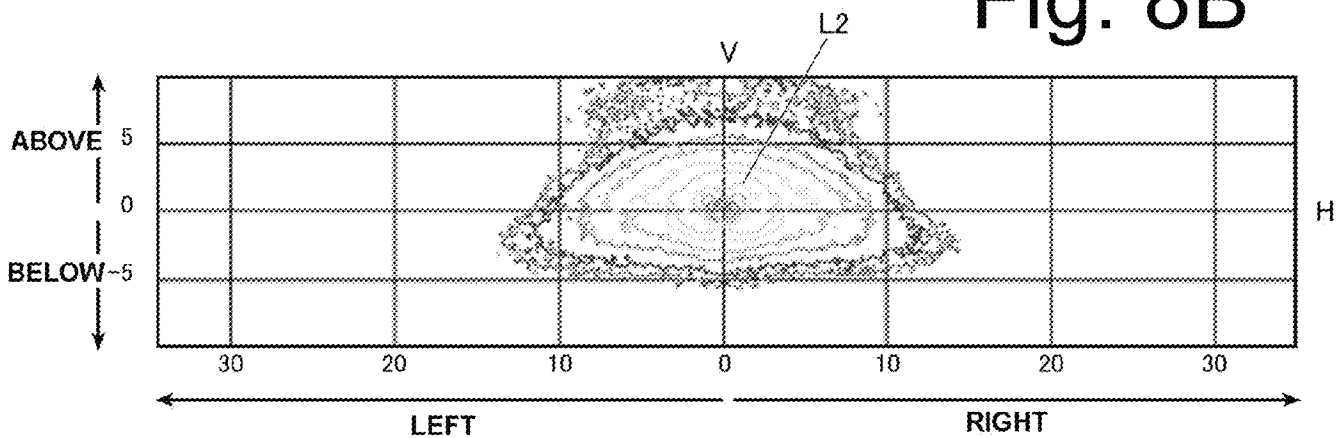

Because the front edge 75 of the separation plate 71 (front edge 75 of the flat reflecting surface 61) can be positioned further rear than the focal point F2 of the upper-level lens portion 82 and the second focal point 42 of the second elliptical reflector surface 41, the light beams reflected by the second elliptical reflector surface 41 can hardly be blocked by the separation plate 71 (refer to FIG. 6). For this reason, the light beams that are reflected by the second elliptical reflector surface 41 and which are then projected towards the front by the upper-level lens portion 82 can form a light distribution pattern used for a high beam (for travel) towards the front of the headlight 1 as shown in FIG. 8B. FIG. 8B is an equiluminous line showing a light distribution pattern, formed on a virtual screen separated at a fixed distance towards the front from the headlight 1 when the second light emitting element 20 emits light beams. In FIG. 8B, the horizontal axis shows a horizontal angle while the intersection between the optical axis Ax and the virtual screen is represented by zero degrees and the vertical axis shows a vertical angle while the intersection between the optical axis Ax and the virtual screen is represented by zero degrees.

As shown in FIG. 8B, this light distribution pattern can have a bright portion L2 in a center area (intersection of the optical axis Ax and the virtual screen and close to that area). This bright portion L2 appears below and above the H line.

Also, with reference to FIG. 7, the light beams reflected from the second light emitting element 20 can be reflected towards the front by the hyperbolic reflecting surface 51. Then, the reflected light can be projected forward by the lower-level lens portion 83. The outside focal point F52 of the hyperbolic reflecting surface 51 can be positioned at or near the focal point F3 of the lower-level lens portion 83. Therefore, the light beams reflected by the hyperbolic reflecting surface 51 and projected forward by the lower-level lens portion 83 are almost parallel beams. Because of this, the illumination range of the light beams reflected by the hyperbolic reflecting surface 51 and projected by the lower-level lens portion 83 will be within a bright portion L2 of the light distribution pattern shown in FIG. 8B. Consequently, the hyperbolic reflecting surface 51 and the lower-level lens portion 83 may only brighten the bright portion L2 of the light distribution pattern shown in FIG. 8B.

The light beams emitted from the second light emitting element 20 can be incident on the mid-level lens portion 81 without being reflected by the reflector surfaces 51 and 61, and the light beams can be projected forward by the mid-level lens portion 81. The illumination range of the light beams will be within bright portion L2 of the light distribution pattern shown in FIG. 8B. Because of this, the light beams emitted from the second light emitting element 20 and which are directly incident on the mid-level lens portion 81 can brighten the bright portion L2 of the light distribution pattern shown in FIG. 8B.

As described above, according to the present exemplary embodiment, since the light emitting elements 10 and 20 can selectively emit light beams without both of them emitting light beams at the same time, power consumption can be suppressed. In particular, when the light distribution pattern is formed for a high beam (refer to FIG. 8B), the first light emitting element 10 will not emit light beams while the light beams emitted from the second light emitting element 20 will hardly be blocked, thereby making it possible to suppress power consumption.

Furthermore, because the light emitting elements 10 and 20 can selectively emit light beams, the amount of heat generated can also be controlled. The heat sink shared by both of the light emitting elements 10 and 20 can be reduced in size and weight.

Even further, when the light distribution pattern is formed for a low beam (refer to FIG. 8A), the first light emitting element 10 will emit light beams and from among the portions of the multi-focal lens 80, the mid-level lens portion 81 will mainly contribute to the formation of this light distribution pattern. In contrast, when the light distribution pattern is formed for a high beam, the second light emitting element 20 will emit light beams and, from among the portions of the multi-focal lens 80, the upper-level lens portion 82 and the lower-level lens portion 83 will mainly contribute to the formation of this light distribution pattern. Because these light distribution patterns are not those formed by overlapping both of the light emitting elements 10 and 20, it is possible to suppress unevenness in the brightness distribution of the light distribution patterns. In particular, in a light distribution pattern for a high-beam it is possible to suppress excessive brightness at a region close to the intersecting line H as well as control unevenness.

Since the axis Ax1 of the first elliptical reflector surface 31 can incline upwards towards the front and the first light emitting element 10 can face upward in a state inclined rearward with respect to the vertical direction, the bright portion L1 of the light distribution pattern for a low beam becomes brighter.

Figure 9:
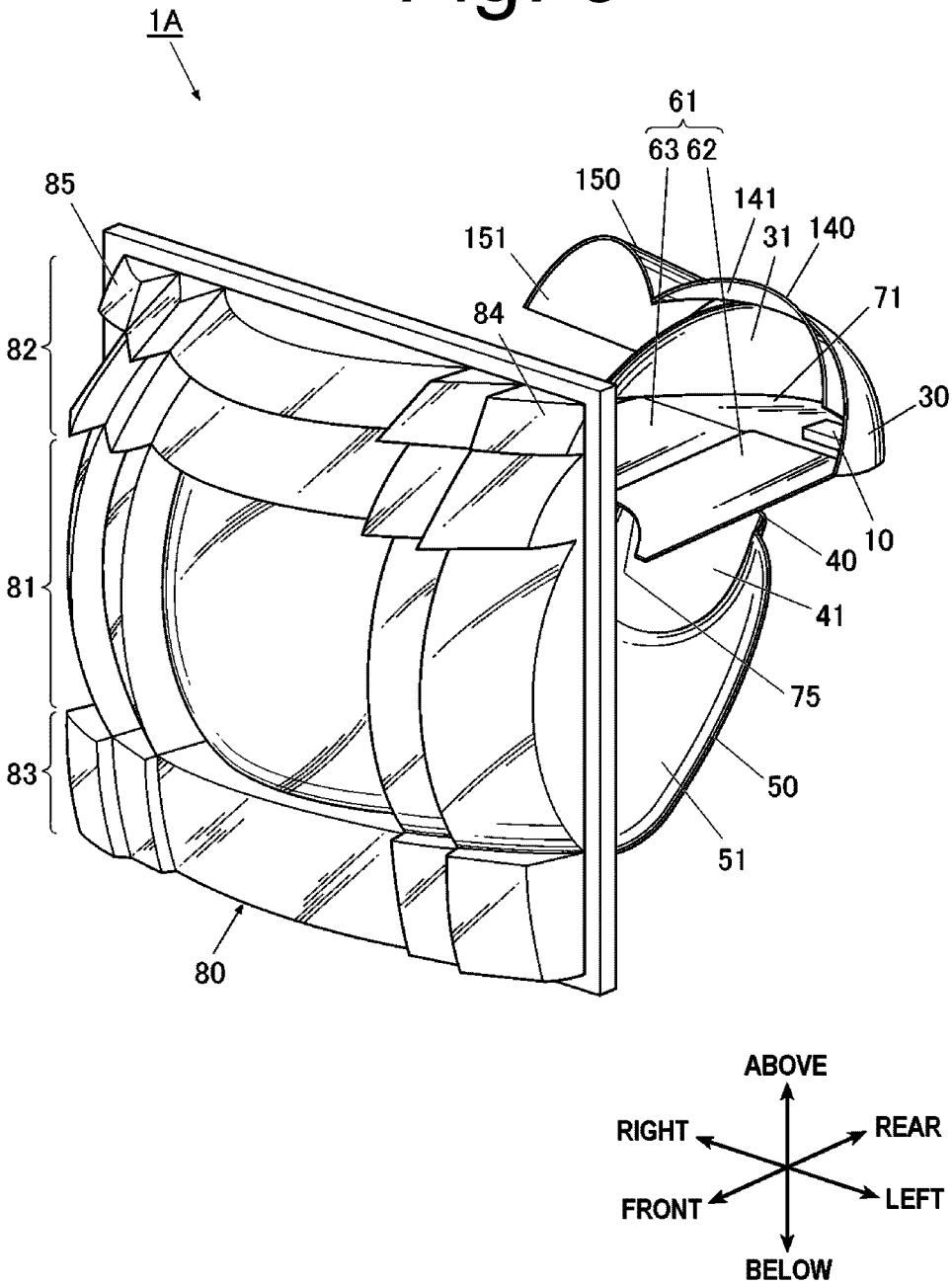
FIG. 9 is a front perspective view of a headlight of a second exemplary embodiment made in accordance with principles of the presently disclosed subject matter.
Figure 10:
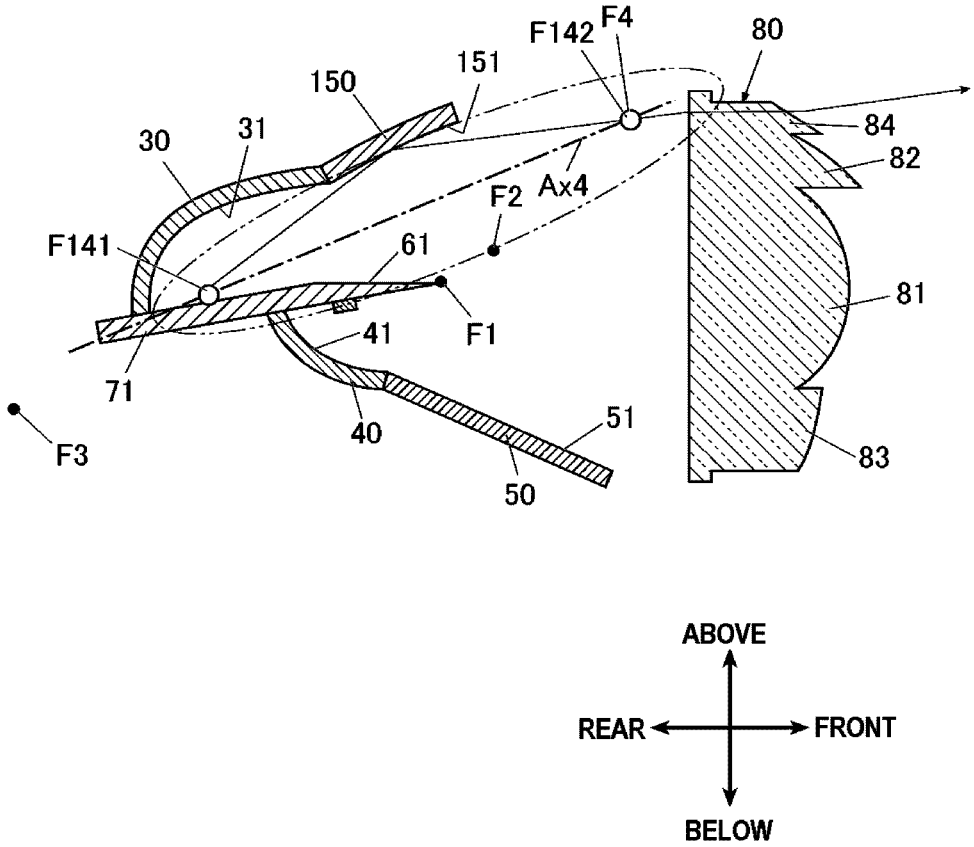
FIG. 10 is a vertical cross sectional view of the headlight of the second exemplary embodiment.
Figure 11D:
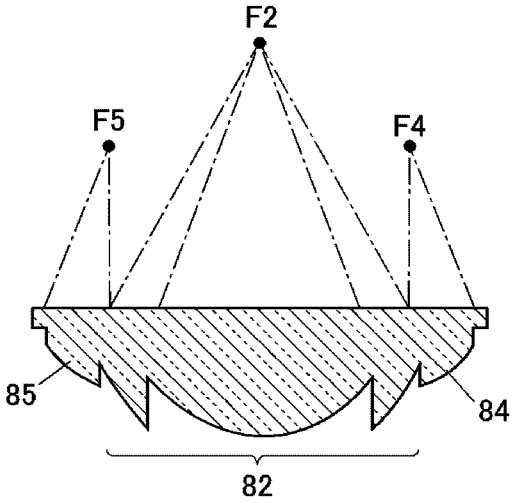
FIGS. 11A, 11B, 11C, and 11D are a front view of a multi-focal lens of the second exemplary embodiment, a side view of the multi-focal lens, a bottom view of the multi-focal lens and a cross sectional view taken along line D-D of the multi-focal lens of FIG. 11A, respectively.
Figure 11B:
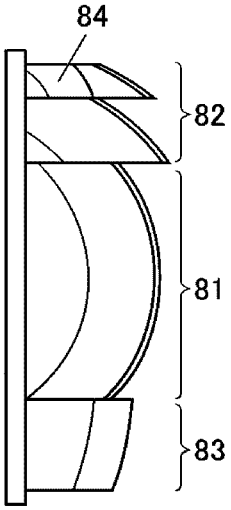
Figure 11A:
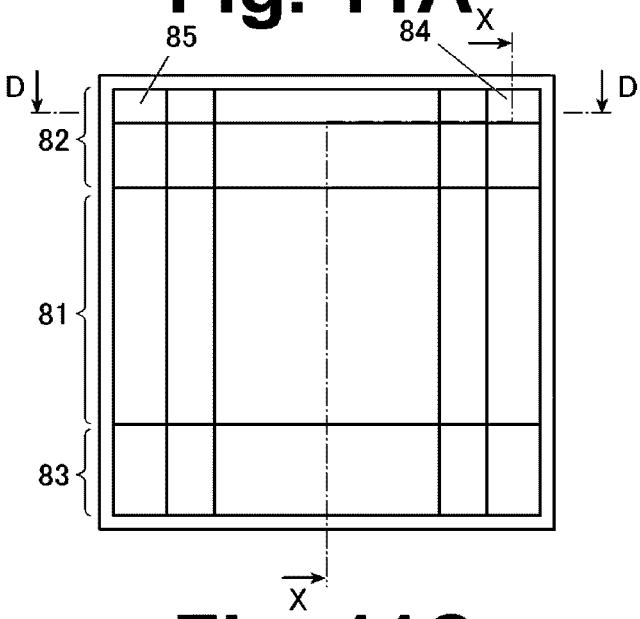
Figure 11C:
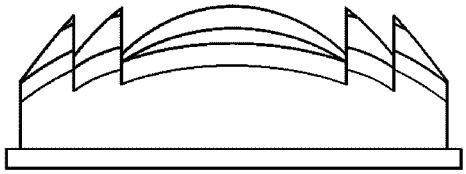

FIG. 9 is a front perspective view of a headlight 1A. FIG. 10 is a cross sectional view taken along a vertical cross section of the headlight 1A. FIGS. 11A, 11B, 11C, and 11D are a front view, a side view, a bottom view and a cross sectional view taken along line D-D of the multi-focal lens 80 of the headlight 1A in the second exemplary embodiment, respectively. FIG. 10 is a cross sectional view taken along line X-X of FIG. 11A.

Identical or substantially similar members corresponding to each other in the headlight 1A in the second exemplary embodiment and the headlight 1 in the first exemplary embodiment are denoted by the same reference numerals. In the following, when identical or substantially similar members corresponding to each other in the headlight 1A in the second exemplary embodiment and the headlight 1 in the first exemplary embodiment are provided, their descriptions will be omitted and the differences will be described.

In the first exemplary embodiment, in contrast to the multi-focal lens 80 being composed of the mid-level lens portion 81, the upper-level lens portion 82, and the lower-level lens portion 83, in the second exemplary embodiment, the multi-focal lens 80 can be configured to include the mid-level lens portion 81, the upper-level lens portion 82, and the lower-level lens portion 83 as well as a pair of left and right overhead sign light distributing lens portions 84 and 85.

One of the overhead sign light distributing lens portions 84 can be provided at the upper left of the upper-level lens portion 82 and the other overhead sign light distributing lens portion 85 can be provided at the upper right of the upper-level lens portion 82. The overhead sign light distributing lens portions 84 and 85 can be formed by aspherical convex lenses. The focal points F4 and F5 of the overhead sign light distributing lens portions 84 and 85 can be set at the rear of the overhead sign light distributing lens portions 84 and 85. The focal length of the overhead sign light distributing lens portions 84 and 85 can be shorter than the focal length of the mid-level lens portion 81 and the upper-level lens portion 82. Therefore, the focal points F4 and F5 of the overhead sign light distributing lens portions 84 and 85 can be positioned in front of the focal point F1 of the mid-level lens portion 81 and the focal point F2 of the upper-level lens portion 82. When viewed from the vertical direction, the focal point F4 of the left overhead sign light distributing lens portion 84 can be arranged to be shifted left from the optical axis Ax. Further, the focal point F5 of the right overhead sign light distributing lens portion 85 can be arranged to be shifted right from the optical axis Ax. When viewed in the horizontal direction, the focal points F4 and F5 of the overhead sign light distributing lens portions 84 and 85 can be arranged to be shifted upwards from the optical axis Ax. In addition, the focal points F4 and F5 can also be positioned higher than the focal point F1 of the mid-level lens portion 81 and the focal point F2 of the upper-level lens portion 82.

In this second exemplary embodiment, the headlight 1A can also have a pair of left and right third elliptical reflectors 140 and 150. The third elliptical reflectors 140 and 150 can be arranged at the rear of the multi-focal lens 80 and in front of the first elliptical reflector 30. One of the third elliptical reflectors 140 can be arranged diagonally forward at the upper left of the first light emitting element 10 and the other third elliptical reflector surface 150 can be arranged diagonally forward at the upper right of the first light emitting element 10.

Concave third elliptical reflecting surfaces 141 and 151 can be provided on the inner surfaces on the lower side of the third elliptical reflectors 140 and 150. The third elliptical reflecting surfaces 141 and 151 can be formed in an elliptical shape. In other words, the left third elliptical reflecting surface 141 can be a revolved elliptical surface around the axis Ax4 that extends diagonally forward towards the upper left from the first light emitting element 10 as a rotational axis or a free curved surface based on the revolved elliptical surface. The right third elliptical reflecting surface 151 can be a revolved elliptical surface around the axis that extends diagonally forward towards the upper right from the first light emitting element 10 as a rotational axis or a free curved surface based on the revolved elliptical surface.

The first focal point F141 of the third elliptical reflector 140 can be set at or near the first light emitting element 10 and the second focal point F142 of the third elliptical reflector 140 can be set at or near the focal point F4 of the overhead sign light distributing lens portion 84. The first focal point of the third elliptical reflector 150 can be set at or near the first light emitting element 10 and the second focal point of the third elliptical reflector 150 can be set at or near the focal point F5 of the overhead sign light distributing lens portion 85.

In the above description, identical or substantially similar members corresponding to each other were provided in the headlight 1A in the second exemplary embodiment and the headlight 1 in the first exemplary embodiment.

In this headlight 1A, the light emitting elements 10 and 20 can selectively emit light beams.

Figure 12A:
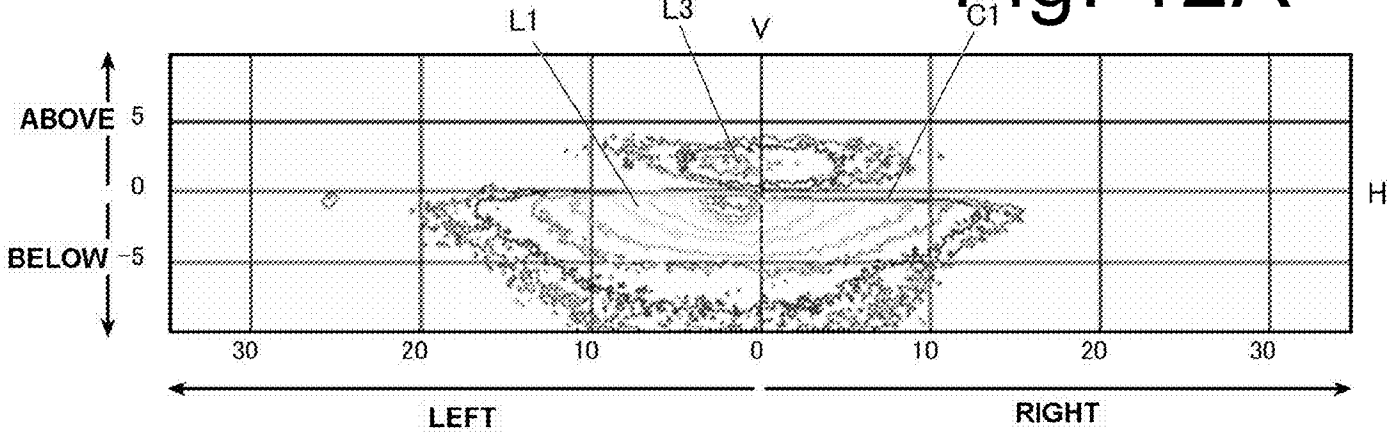
FIGS. 12A and 12B show light distribution patterns formed on a virtual screen for the headlight of the second exemplary embodiment.

When the first light emitting element 10 emits light beams, a light distribution pattern can be formed having a cutoff line C1 along the intersecting line H on an upper edge of bright portion L1 as shown in FIG. 12A. This light distribution pattern is similar to the first exemplary embodiment in that it is mainly formed by the first elliptical reflector surface 31, the flat reflecting surface 61, and the mid-level lens portion 81. In addition to this type of light distribution pattern, a light distribution pattern can also be formed so as to have a bright portion L3 higher than the intersecting line H. This light distribution pattern can be formed by the third elliptical reflecting surfaces 141 and 151 and the overhead sign light distributing lens portions 84 and 85. In other words, the light beams emitted from the first light emitting element 10 and then reflected by the third elliptical reflecting surfaces 141 and 151 can be converged on the focal points F4 and F5 and the converged light beams can be projected forward by the overhead sign light distributing lens portions 84 and 85 thereby forming the bright portion L3 higher than the intersecting line H. It should be appreciated that the bright portion L1 can be brighter than the bright portion L3.

Figure 12B:
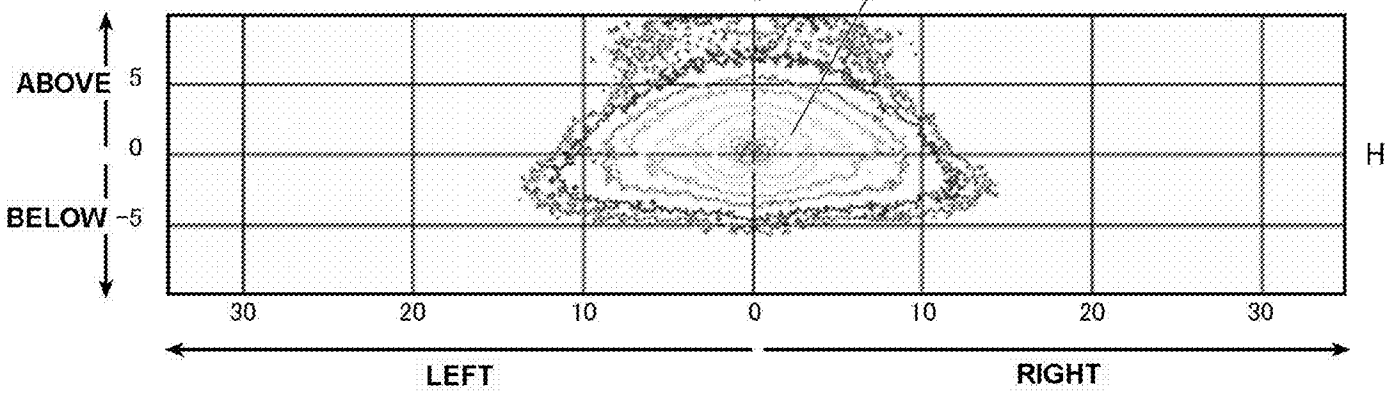

The light distribution when the second light emitting element 20 emits light beams may be almost the same as the light distribution for first exemplary embodiment. This light distribution pattern is shown in FIG. 12B.

In the present exemplary embodiment, while a light distribution pattern for a high beam is formed, power consumption can be suppressed. In addition, it is also possible to suppress excessive brightness close to the H line and unevenness in a light distribution pattern for a high beam. Even further, the upper-level lens portion 82 and the lower-level lens portion 83 do not cause glare towards oncoming vehicles.

In the above-mentioned first exemplary embodiment and second exemplary embodiment, the multi-focal lens 80 does not have to be provided with the lower-level lens portion 83 or with the hyperbolic reflector 50. Furthermore, it is contemplated that the various components from each of the embodiments can be placed onto or incorporated into other embodiments.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light comprising:

a multi-focal lens that has, a mid-level lens portion whose focal point is located on an optical axis extending in a front-to-rear direction, and an upper-level lens portion located above the mid-level lens portion and whose focal point is located diagonally frontward and above the focal point of the mid-level lens portion;

a separator plate configured in a face-down state with respect to a horizontal plane and located at a rear of the multi-focal lens, the separator plate having a front edge positioned substantially at the focal point of the mid-level lens portion;

a first light emitting element mounted on a top of the separator plate at a rear portion located a substantial distance from the front edge of the separator plate, the first light emitting element facing upwards;

a second light emitting element mounted on a bottom of the separator plate and spaced from the front edge of the separator plate, the second light emitting element facing downwards;

a first elliptical reflecting surface located on the top of the separator plate, the first elliptical reflecting surface having a first focal point located substantially at the first light emitting element and a second focal point located substantially at the focal point of the mid-level lens portion; and a second elliptical reflecting surface located on the bottom of the separator plate, the second elliptical reflecting surface having a first focal point located substantially at the second light emitting element and a second focal point located substantially at the focal point of the upper-level lens portion, wherein the vehicle light is configured such that the first light emitting element and the second light emitting element selectively emit light beams.

2. The vehicle light according to claim 1, wherein the first light emitting element has an optical axis oriented upward in a state inclining rearward 0° to 20° with respect to a vertical direction.

3. The vehicle light according to claim 1, wherein the second light emitting element has an optical axis oriented downward in a state inclining forward 10° to 20° with respect to a vertical direction.

4. The vehicle light according to claim 1, wherein the multi-focal lens further comprises an overhead lens configured to distribute light towards an overhead sign, the overhead lens being located on an upper left or an upper right of the upper-level lens portion, and the overhead lens having a focal point located above and in front of the focal point of the upper-level lens portion, and wherein the vehicle light further comprises a third elliptical reflecting surface located diagonally frontward and above the first elliptical reflecting surface, third elliptical reflecting surface having a first focal point located substantially at the first light emitting element and a second focal point located substantially at the focal point of the overhead lens.

5. The vehicle light according to claim 4, wherein the first light emitting element has an optical axis oriented upward in a state inclining rearward 0° to 20° with respect to a vertical direction.

6. The vehicle light according to claim 1, further comprising a flat reflecting surface located between the front edge of the upper surface of the separator plate and the first light emitting element and configured to be parallel with the horizontal plane.

7. The vehicle light according to claim 6, wherein the multi-focal lens further an overhead lens configured to distribute light towards an overhead sign, the overhead lens being located on an upper left or an upper right of the upper-level lens portion and the overhead lens having a focal point located above and in front of the focal point of the upper-level lens portion, and wherein the vehicle light further comprises a third elliptical reflecting surface located diagonally frontward and above the first elliptical reflecting surface, third elliptical reflecting surface having a first focal point located substantially at the first light emitting element and a second focal point located substantially at the focal point of the overhead lens.

8. The vehicle light according to claim 6, wherein the first light emitting element has an optical axis oriented upward in a state inclining rearward 0° to 20° with respect to a vertical direction.

9. The vehicle light according to claim 1, wherein the multi-focal lens further comprises a lower-level lens portion located below the mid-level lens portion, the lower-level lens portion having a focal point located diagonally rearward and below the focal point of the mid-level lens portion, and wherein the vehicle light further comprises a hyperbolic reflecting surface located diagonally frontward and below the second elliptical reflecting surface and having an inner focal point located substantially at the second light emitting element and having an outer focal point located substantially at the focal point of the lower-level lens portion.

10. The vehicle light according to claim 9, wherein the multi-focal lens further comprises an overhead lens configured to distribute light towards an overhead sign, the overhead lens being located on an upper left or an upper right of the upper-level lens portion and the overhead lens having a focal point located above and in front of the focal point of the upper-level lens portion, and wherein the vehicle light further comprises a third elliptical reflecting surface located diagonally frontward and above the first elliptical reflecting surface, third elliptical reflecting surface having a first focal point located substantially at the first light emitting element and a second focal point located substantially at the focal point of the overhead lens.

11. The vehicle light according to claim 9, wherein the first light emitting element has an optical axis oriented upward in a state inclining rearward 0° to 20° with respect to a vertical direction.

12. The vehicle light according to claim 9, wherein the second light emitting element has an optical axis oriented downward in a state inclining forward 10° to 20° with respect to a vertical direction.

13. The vehicle light according to claim 9, further comprising a flat reflecting surface located between the front edge of the upper surface of the separator plate and the first light emitting element and configured to be parallel with the horizontal plane.

14. The vehicle light according to claim 13, wherein the multi-focal lens further an overhead lens configured to distribute light towards an overhead sign, the overhead lens being located on an upper left or an upper right of the upper-level lens portion and the overhead lens having a focal point located above and in front of the focal point of the upper-level lens portion, and wherein the vehicle light further comprises a third elliptical reflecting surface located diagonally frontward and above the first elliptical reflecting surface, third elliptical reflecting surface having a first focal point located substantially at the first light emitting element and a second focal point located substantially at the focal point of the overhead lens.

15. The vehicle light according to claim 13, wherein the first light emitting element has an optical axis oriented upward in a state inclining rearward 0° to 20° with respect to a vertical direction.

16. The vehicle light according to claim 9, wherein, when viewing the multi-focal lens from the front direction, a surface area of a region occupied by the mid-level lens portion is approximately a sum of a surface area of a region occupied by the upper-level lens portion and a surface area of a region occupied by the lower-level lens portion.

17. The vehicle light according to claim 16, wherein the multi-focal lens further comprises an overhead lens configured to distribute light towards an overhead sign, the overhead lens being located on an upper left or an upper right of the upper-level lens portion and the overhead lens having a focal point located above and in front of the focal point of the upper-level lens portion, and wherein the vehicle light further comprises a third elliptical reflecting surface located diagonally frontward and above the first elliptical reflecting surface, third elliptical reflecting surface having a first focal point located substantially at the first light emitting element and a second focal point located substantially at the focal point of the overhead lens.

18. The vehicle light according to claim 16, wherein the first light emitting element has an optical axis oriented upward in a state inclining rearward 0° to 20° with respect to a vertical direction.

19. The vehicle light according to claim 16, further comprising a flat reflecting surface located between the front edge of the upper surface of the separator plate and the first light emitting element and configured to be parallel with the horizontal plane.

20. The vehicle light according to claim 19, wherein the multi-focal lens further an overhead lens configured to distribute light towards an overhead sign, the overhead lens being located on an upper left or an upper right of the upper-level lens portion and the overhead lens having a focal point located above and in front of the focal point of the upper-level lens portion, and wherein the vehicle light further comprises a third elliptical reflecting surface located diagonally frontward and above the first elliptical reflecting surface, third elliptical reflecting surface having a first focal point located substantially at the first light emitting element and a second focal point located substantially at the focal point of the overhead lens.

* * * * *